United States Patent [19]

Feinzilber et al.

[11] 4,045,893

[45] Sept. 6, 1977

[54] AUTOMATED PLANER

[76] Inventors: Mikhail Leibovich Feinzilber, Budapeshtskaya ulitsa, 17, korpus 5, kv. 62; Eduard Nikolaevich Kuzin, ulitsa 3 Internatsionala, 74, kv. 199; Gennady Ivanovich Timofeev, ulitsa 3 Internatsionala, 69, kv. 97, all of Leningrad; Semen Semenovich Roitershtein, ulitsa Generala Khazova, 32, kv. 20, Pushkin Leningradskoi oblasti; Jury Stepanovich Kozlov, ulitsa Dimitrova, 10, korpus 1, kv. 160, Leningrad; Vladimir Fedorovich Korelin, ulitsa Belgradskaya, 20, kv. 123, Leningrad; Nikolai Vasilievich Dmitrievsky, Piskarevsky prospekt, 10, kv. 289, Leningrad; Igor Petrovich Bratyshev, proezd Solomennoi Storozhki, 12a, kv. 52; Fedor Evstafievich Omelyan, ulitsa Zhivopisnaya, 5, korpus 4, kv. 49, both of Moscow; Efim Iosifovich Sheinis, Budapeshtskaya ulitsa, 17, korpus 5, kv. 75, Leningrad; Vladimir Grigorievich Pak, ulitsa Rakhimova, 3; Vladimir Ivanovich Romanov, mikroraion 2, 36, kv. 29, both of Andizhan; Zalman Eremeevich Garbuzov, ulitsa Michurinskaya, 13, kv. 20, Leningrad, all of U.S.S.R.; Grigory Borisovich Naret, deceased, late of Leningrad, U.S.S.R., by Avgustina Alexandrovna Naret, administrator

[21] Appl. No.: 679,131

[22] Filed: Apr. 22, 1976

[51] Int. Cl.[2] ..... E02F 5/00

[52] U.S. Cl. ..... 37/108 A; 172/4.5; 37/DIG. 20

[58] Field of Search ..... 37/108, DIG. 1, DIG. 20, 37/124, 126 R, 129, 126 A, 126 AE; 172/4, 4.5

[56] References Cited

U.S. PATENT DOCUMENTS

| | | | |
|---|---|---|---|
| 2,154,503 | 4/1939 | French et al. | 37/DIG. 19 |
| 2,755,721 | 7/1956 | Rusconi | 37/DIG. 1 |
| 2,934,078 | 4/1960 | Gurries et al. | 172/4.5 X |
| 2,952,245 | 9/1960 | Curlett et al. | 172/4.5 X |
| 3,052,997 | 9/1962 | Holland | 37/DIG. 20 |
| 3,093,946 | 6/1963 | Pitt et al. | 37/DIG. 1 |

FOREIGN PATENT DOCUMENTS

| | | | |
|---|---|---|---|
| 641,387 | 5/1962 | Canada | 37/DIG. 1 |

*Primary Examiner*—E. H. Eickholt
*Attorney, Agent, or Firm*—Robert E. Burns; Emmanuel J. Lobato; Bruce L. Adams

[57] ABSTRACT

An automatic planer comprising hinged fore and rear frames, a scoop with a cutting edge, a running gear, a planer dip angle pickup and a ground level pickup, an engagement mechanism of a prime-mover engine clutch, mainly tractor. The dip angle pickup is connected by means of one electrohydraulic distributor to a hydraulic cylinder joining the rear and fore frames and the scoop is secured on the fore frame and provided with side walls joined by a bottom plate in their rear part and a back wall, which can move in slideways parallel to the bottom plate and is connected to the fore frame by means of another hydraulic cylinder in its turn coupled by means of another electrohydraulic distributor to the ground level pickup positioned in front of the scoop cutting edge.

11 Claims, 8 Drawing Figures

AUTOMATED PLANER

BACKGROUND OF THE INVENTION

This invention relates to machine building for construction, road-building and melioration works and, in particular, to automated planers used to plane the surface of the ground.

There are known trailer long-wheelbase planers (the wheelbase is the distance between the fore and rear axles), comprising hinged fore and rear frames and a scoop with a cutting edge mounted on the fore frame, running gear and hydraulic cylinders.

Long-wheelbase planers feature a wheelbase of 15–18 m, which is required to ensure adequate planing of the ground surface. Such machines are heavy and difficult to maneuver and cannot be employed in restricted conditions, e.g. for rice fields planing.

Besides, the forementioned planers are equipped with a bottomless scoop featuring an immovable rear wall and the entire mass of scooped earth is dragged over the ground surface, which involves increased resistance to the planer movement. In case the tractor thrust force is limited, this results in less earth volume in the scoop and, consequently, reduces the quality of planing, when filling up recesses, constituting a major drawback of such a planer.

There is known a trailer long-wheelbase planer, eliminating this drawback. This planer is equipped with a scoop featuring a swivel wall hinged to an underblade plate actuated by a pulley-and-rope system. This design is deficient in that it demands great consumption of energy per unit of planed ground area, involves lifting considerable amounts of earth masses, and nonuniform recess filling on the planed area.

In all the forementioned trailer long wheelbase planers the height of the scoop in relation to the wheels is adjusted manually resulting in sharp decrease of efficiency.

Also planers are known which are equipped with automatic devices for the scoop height adjustment. Employment of automatic devices permits a wheelbase of a planer with its planing efficiency kept on the same level (or even raised).

This is, for example, an automatic system for a planer working member control. This system comprises two adjustment circuits composed of a dip angle pickup, electrohydraulic distributors and a contact device, which operates depending on the reciprocal position of fore and rear indication struts, making the system complicated and insufficiently reliable in operation.

It is known that dip angle pickups are sensitive to inertial forces acting in the plane of the measured angle. Such forces may occur in irregular planer movement, particularly when the tractor towing the planer starts or stops. The pickup produces false signals in this case, which results in worse planing characteristics of the planer and is also a drawback of such an automatic system.

SUMMARY OF THE INVENTION

It is an object of this invention to raise the planing capabilities and the efficiency of a planer.

Another object of this invention is to shorten the wheelbase of a planer to increase its maneuverability and reduce its weight.

Yet another object of the invention is to reduce the resistance to digging and energy expenditures on a unit of the ground area being planed.

A further object of the invention is to improve the operator's working conditions in controlling the planer.

A still further object of the invention is to cut the effect of false interferences on the dip angle pickup and to increase the accuracy of the automatic control system.

And finally it is an object of the invention to ensure flexibility of control of the planing capability of a planer depending on the peculiarities of the ground relief and physical and mechanical earth properties.

These objects are achieved by that in an automated planer comprising hinged fore and rear frames, a scoop with a cutting edge, running gear, electrohydraulic distributors, hydraulic cylinders, a dip angle pickup, a prime-mover engine clutch engagement mechanism. The dip angle pickup is, according to the invention, connected by means of the electrohydraulic distributor to hydraulic cylinders joining the fore and rear frames and the scoop secured on the fore frame features side walls connected in the rear part by bottom plates and a rear wall mounted on slideways running parallel to the bottom plate and connected to the fore frame by means of a hydraulic cylinder, which is in its turn connected by means of an electrohydraulic distributor to the ground level pickup installed in front of the scoop cutting edge.

It is advisable to install the dip angle pickup so that its axis coincides with the axis of the joint connecting the fore and rear frames.

It is also advisable to join the dip angle pickup casing with the rear frame. The proposed planer may be equipped with an additional frame hinged to the fore and rear frames at the joint. The dip angle pickup may be installed on an additional frame, its casing in this case being connected to the additional frame.

It is also expedient to install the dip angle pickup on the rear frame. The dip angle pickup may be in this case connected to a hydraulic cylinder by means of a system comprising a control board, an electrical switch and a delay unit, the electrical switch being connected via the delay unit to the clutch engagement mechanism of the prime-moved engine.

The electrical switch may be connected to a switch board by means of a joint angle pickup (in this case denoting the angle of the fore frame in relation to the rear frame).

It is expedient to connect the dip angle pickup casing to the rear part of the frame by means of a crank mechanism, its crank being hinged by a rod to the fore frame so that said crank mechanism and the rod together with the pickup casing, the fore and rear frames form two hinged four-link chains, the rear frame and the crank being their common links.

The dip angle pickup casing may be connected to the additional frame by means of a crank mechanism, its crank being hinged by a rod to the fore frame so that this crank mechanism and the rod together with the pickup casing and the fore and additional frames form two hinged four-link chains, the additional frame and the crank being their common links.

The efficiency of this planer has been proven theoretically and experimentally in the process of tests, where the proposed planer characteristics were compared to the characteristics of the forementioned planer made according to the Inventors Certificate No. 241,298 and the following advantages over that planer were established:

1. A 25% shorter wheelbase;
2. Twofold increase of efficiency;
3. Specific metal consumption reduced by 150%;
4. Specific energy consumption reduced by 15%;
5. Planing ability increased by 20%.

On the whole, employment of the planer made in accordance with this invention ensures a considerable economic effect.

BRIEF DESCRIPTION OF THE DRAWINGS

For better understanding of an automated planer the invention will now be described with reference to a specific embodiment thereof taken in conjunction with the accompanying drawings, wherein.

DESCRIPTION OF THE PREFERRED EMBODIMENT

Figure 1:
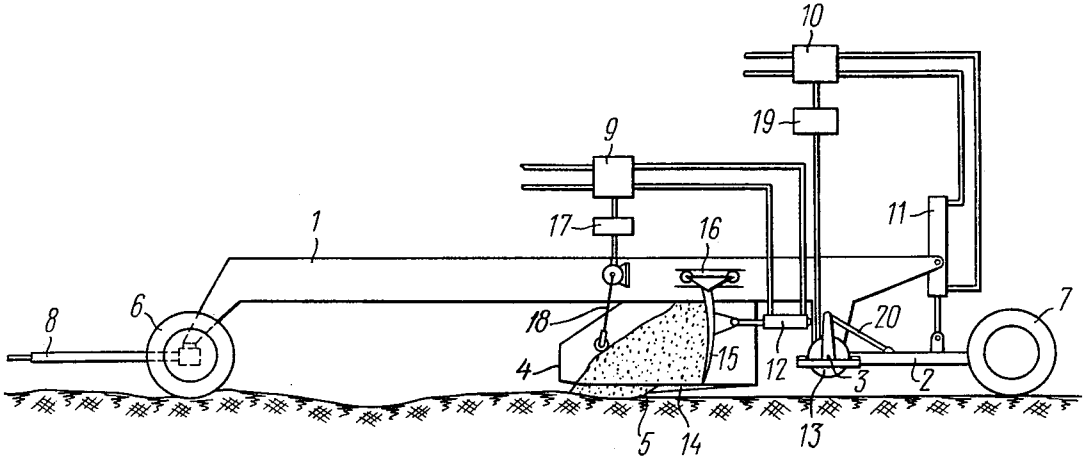
FIG. 1 is a schematic of the proposed planer, according to the invention.

An automated planer comprises a fore frame 1 (FIG. 1) and a rear frame 2 connected by a joint 3, a scoop with side walls 4 and a cutting edge 5, running gears 6 and 7, a rod 8 to tow the planer by a prime-mover, electrohydraulic distributors 9 and 10, hydraulic cylinders 11 and 12, a dip angle pickup 13 and a clutch engagement mechanism of a prime-mover, e.g. a tractor (not shown).

A scoop with the side walls 4 secured on the front part of the frame is provided with a bottom 14 connecting said walls at their rear part and a rear wall 15. The rear wall 15 is mounted on slideways 16 running parallel to the scoop bottom 14 and is connected to the hydraulic cylinder 12.

The hydraulic cylinder 12 is connected through the electrohydraulic distributor 9 and a control board 17 to a ground level pickup 18 mounted in the front part of the scoop before the cutting edge 5.

The hydraulic cylinder 11 is connected through the electrohydraulic distributor 10 and a control board 19 to the dip angle pickup 13, which is connected to the rear frame 2 by means of a rod 20.

Figure 2:
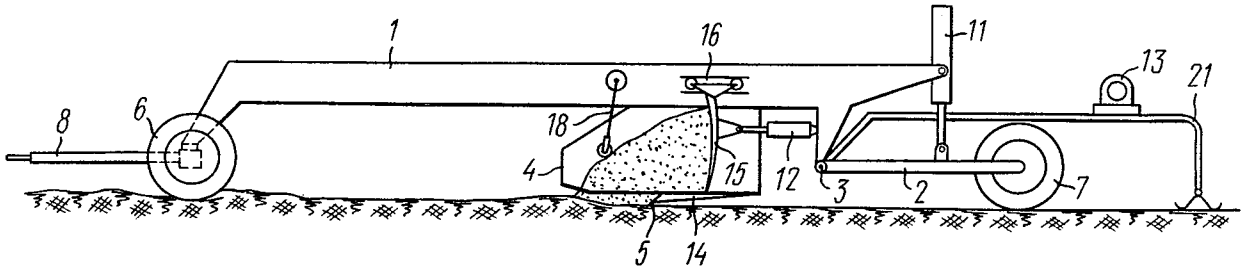
FIG. 2 shows an automated planer, according to the invention, wherein an additional frame is provided.

Another embodiment of an automated planer is provided to increase its planing efficiency with an additional frame 21 (FIG. 2), which is hinged to the fore frame 1 and the rear frame 2 at the spot of their coupling by the joint 3, whereas the dip angle pickup is rigidly attached to the additional frame 21.

Figure 3:
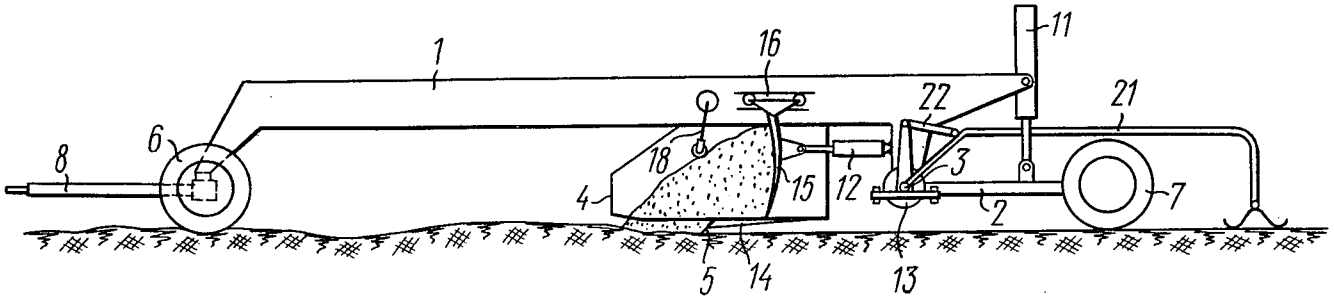
FIG. 3 is a side elevation view of an automated planer, wherein a dip angle pick-up is connected to an additional frame.

In still another embodiment of a planer the additional frame 21 (FIG. 3) is connected by means of a rod 22 to the dip angle pickup positioned so that the axis of the pickup 13 coincides with the axis of the joint 3 connecting the fore frame 1 and the rear frame 2.

Figure 4:
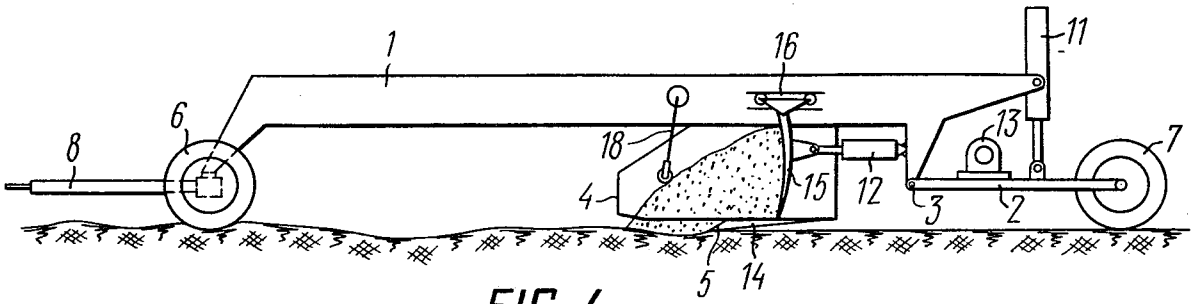
FIG. 4 is a side elevation view of an automated planer, wherein the dip angle pickup is mounted on the rear frame; according to the invention.

Referring to FIG. 4, an embodiment of an automated planer comprises a dip angle pickup 13 positioned on the rear frame 2, the casing of said pickup 13 being rigidly connected to the rear frame 2.

To render the dip angle pickup 13 interference-proof the planer can be provided with a control board 23 (FIG. 5), electrical switches 24 and 25, the switch 25 being mechanically connected to a mechanism 26 for engagement of the prime-mover engine clutch. The switch 24 is electrically connected to a delay unit 27 having a delay for cutting in the switch 24.

Figure 6:
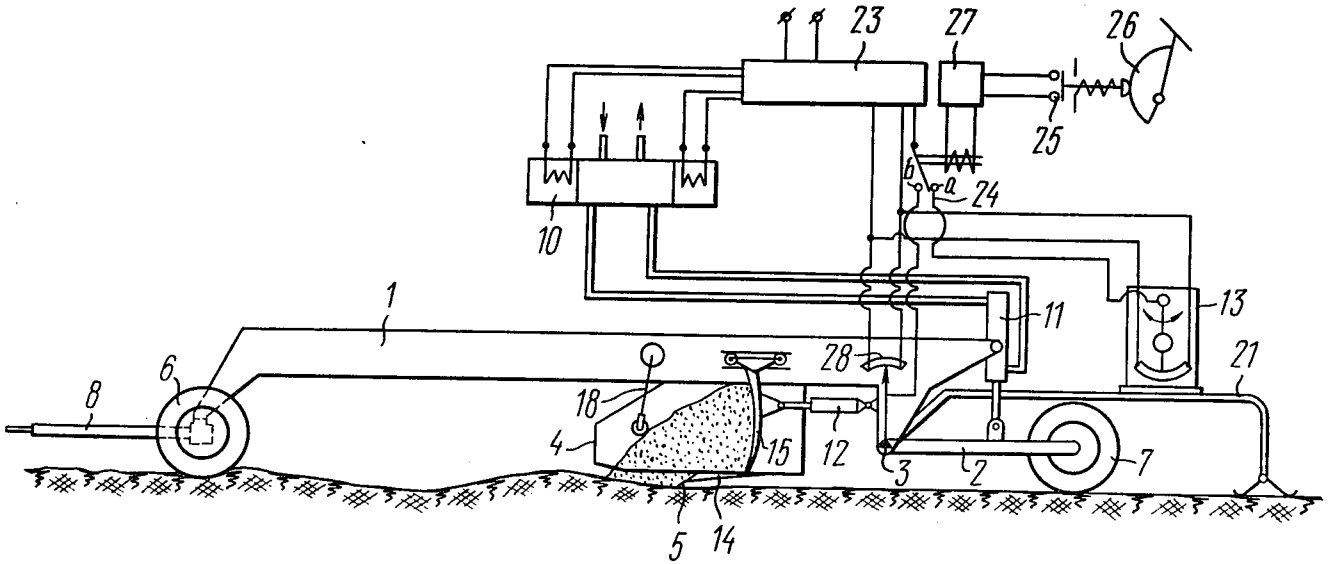
FIG. 6 is a side elevation view of an automated planer, wherein a joint angle pickup is provided, according to the invention.

To render the dip angle pickup 13 interference-proof the planer is provided with a joint angle pickup 28 (FIG. 6) indicating the position of the fore frame 1 in relation to the position of the rear frame 2. The pickup 28 is mounted on the axis of the joint 3 connecting the fore frame 1 and the rear frame 2 and is coupled to the control board 23 via the switch 24.

Figure 7:
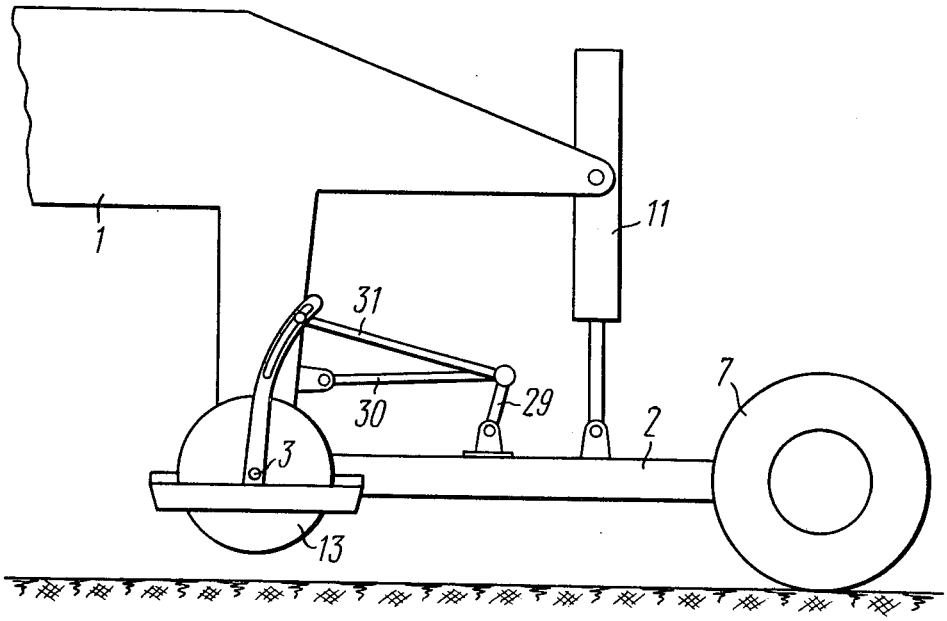
FIG. 7 is a fragmentary elevation view of a rear part of an automated planer, wherein the dip angle pickup is connected by means of a crank mechanism to the rear frame.

Referring to FIG. 7, an automated planer comprises a dip angle pickup 13 connected to the rear frame 2 by means of a crank mechanism, its crank 29 being coupled to the fore frame I by means of a rod 30 and to the casing of the pick up 13 by means of a connecting rod 31 so that said crank mechanism and the rod 30 together with the casing of the dip angle pickup 13 and the fore frame 1 and the rear frame 2 form two hinged four-link chains, the crank 29 and the rear frame 2 being their common links.

Figure 8:
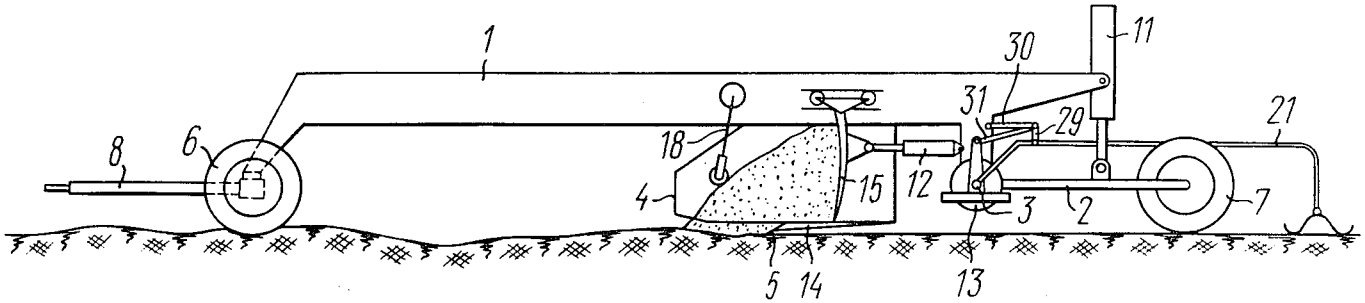
FIG. 8 is a side elevation view of an automated planer, wherein the dip angle pickup is connected by means of a crank mechanism to an additional frame, according to the invention.

Referring to FIG. 8, a planer comprises a dip angle pickup 13 connected to the additional frame 21 by means of a crank mechanism, its crank 29 being connected to the fore frame 1 by means of the rod 30 and to the casing of the pickup 13 by means of the rod 31 so that said crank mechanism and the rod 30 together with the casing of the pickup 13, the fore frame 1 and the additional frame 21 form two hinged four-link chains, the crank 29 and the additional frame 21 being their common link.

The planer operates as follows. The planer is towed as a trailer by a prime-mover so that its front wheels move over uneven ground. When the front wheels 6 run into a recess or rising ground, the planer tilts up or down and actuates the dip angle pickup 13, which controls the hydraulic cylinder by means of the electrohydraulic distributor 10 and thus keeps constant the angle of inclination of the rear frame 2 in relation to the horizontal.

Better planing ability of the planer is ensured in this manner.

When earth is sheared by the cutting edge 5 of the planer scoop, the cut-off earth forms a drag prism, which is moved (dragged) over the field surface. When the volume of earth in the scoop grows, the pickup 18 actuated through the electrohydraulic distributor 9 the hydraulic cylinder 12, which moves back the rear wall 15 and increases the scoop capacity. The additional capacity is provided with the bottom 14 and permits transportation of a part of earth in the scoop rather than drag it over the field surface, which reduces the resistance to the planer advance and energy consumption.

One more embodiment of a planer (FIG. 5) operates as follows. At a constant tractor speed the switch 25 is opened and the switch 24 is in position *a* maintaining permanent connection of the pickup 13 with the control board 23. Gear changing of the tractor actuates the mechanism 26 for engagement of the tractor engine clutch. The switch 25 is cut in and sets the switch 29 into position *b* by an electromagnet.

In this case the electrohydraulic distributor 10 is disconnected from the pickup 13 and the hydraulic cylinder 11 is no longer under the control of said dip angle pickup 13, which at this moment responds to interferences, and this helps to eliminate the effect of inertial forces on the shape of the surface being planed.

When the foot pedal of the clutch 26 is released, the switch 25 is opened, but this signal is transmitted through the delay unit 27 so that the pickup is given time to stabilize. Planing in this case is done without changing the elevation of the scoop in respect to the base level of the planer, that is non-automatically. When the delay time is over, the switch 24 assumes position *a* and the dip angle pickup 13 is made operative.

One more embodiment of a planer (FIG. 6) operates in the same way. However, in this planer, when the switch 29 is transferred into position *b,* the electrohydraulic distributor 10 is connected to the joint angle pickup 28 and the frames 1 and 2 are set at an angle corresponding to the signals of said pickup 28.

In another embodiment of a planer (FIG. 2) the dip angle pickup 13 positioned on the additional frame 21 is actuated not only by the front or rear wheels 6 or 7 running into obstacles but also by the support of the additional frame 21, which furnishes more information on the ground relief to the automation equipment and improves planing efficiency of the planer.

Similar is the operation of the planer (FIG. 3), wherein to improve dynamic properties the dip angle pickup 13 is mounted on the joint 3 and the pickup casing is turned, when not only the fore and rear frames change their position, but when the additional frame 21 connected to the casing by a rod 22 moves.

The operation of the planer (FIG. 4) with the dip angle pickup 13 placed directly on the rear frame 2 is also the same.

The principle of operation of the planer of FIG. 7 consists in that the angle between the rear and fore frames 2 and 1 of the planer changes and this actuates the crank mechanism. The casing of the pickup 13 connected to said crank mechanism is turned about the rear frame so that the input pickup signal grows or diminishes depending on the place where the rod 31 is joined to the casing of the pickup 13.

Connection of the casing of the pickup 13 to planer frames makes the signal controlling the actuating mechanism dependent not only on the position of the stabilized frame in relation to the horizon but also on the angle between the frames, which permits variations of the resultant reaction, that is alteration of the planing ability of the planer, when required.

Figure 5:
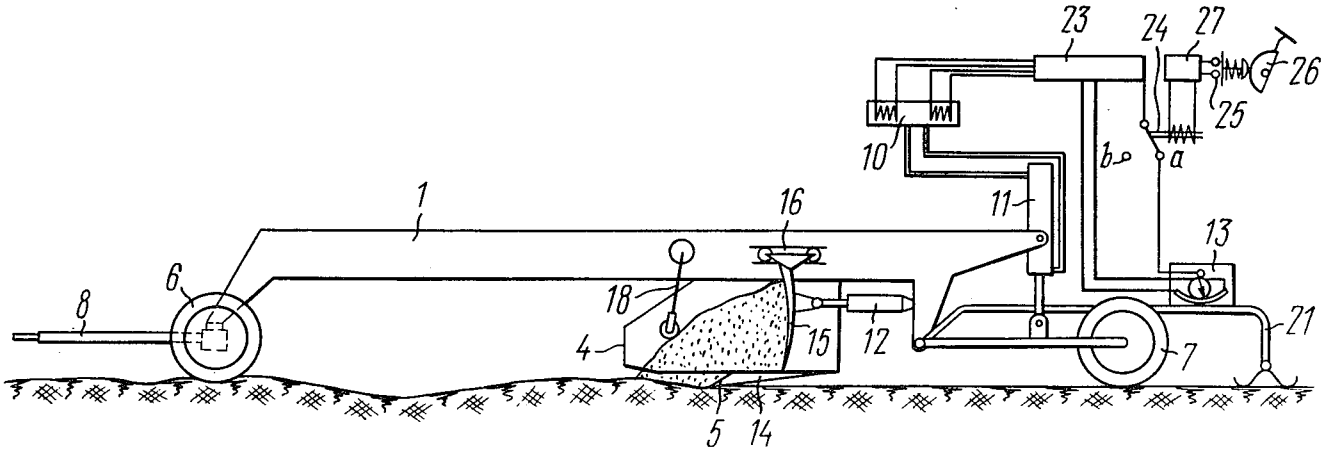
FIG. 5 is a side elevation view of an automated planer, wherein the dip angle pickup is connected to a control board via a delay unit, according to the invention.

The planer of FIG. 5 operates similarly, but the pickup 13 is here dependent on the angle between the fore and rear frames 1 and 2 and the angle between the fore and additional frames 1 and 21.

What is claimed is:

1. An automated planer comprising: a fore frame; a rear frame; a hinged means to connect said fore and rear frames; running gear; a scoop with a cutting edge; electrohydraulic distributors; hydraulic cylinders; a planer dip angle pickup, a prime-mover engine clutch engagement mechanism; a ground level pickup positioned in front of the cutting edge of said scoop; said planer dip angle pickup connected by means of one of said electrohydraulic distributors to one of said hydraulic cylinders joining said rear and fore frames; said scoop with a cutting edge secured on said fore frame with side walls joined by a bottom plate in their rear part and a rear wall positioned in slideways parallel to said bottom plate and connected to said fore frame by means of another of said hydraulic cylinders in its turn connected by another of said electrohydraulic distributors to said ground level pickup.

2. An automated planer as claimed in claim 1, wherein said planer dip angle pickup is placed so that its axis coincides with the axis of the joint connecting said fore and rear frames.

3. An automated planer as claimed in claim 2, wherein a casing of said planer dip angle pickup is connected to the rear frame.

4. An automated planer as claimed in claim 1, wherein an additional frame is hinged to said fore and rear frames at the joint.

5. An automated planer as claimed in claim 4, wherein the planer dip angle pickup is positioned on said additional frame.

6. An automated planer as claimed in claim 4, wherein said planer dip angle pickup is connected to said additional frame.

7. An automated planer as claimed in claim 1, wherein said planer dip angle pickup is mounted on the rear frame.

8. An automated planer as claimed in claim 1, wherein said planer dip angle pickup is connected to one of said hydraulic cylinder by means of a system comprising a control board and an electrical switich connected through a delay unit to said mechanism for engagement of the prime-mover engine clutch.

9. An automated planer as claimed in claim 8, wherein said electrical switch is connected to said control board via a joint angle pickup.

10. An automated planer as claimed in claim 1, wherein the casing of said planer dip angle pickup is connected to the rear frame by means of a crank mechanism, its crank being connected to the fore frame by a rod so that said crank mechanism and the rod together with the dip angle pickup casing, the fore and rear frames form two hinged four-linked chains, the rear frame and said crank being their common link.

11. An automated planer as claimed in claim 1, wherein the planer dip angle pickup is connected to an additional frame by means of a crank mechanism, its crank being connected to the fore frame by a rod so that said crank mechanism and said rod together with the dip angle pickup casing, the fore and additional frames from two hinged four-linked chains, the additional frame and the crank being their common link.

* * * * *